United States Patent [19]

Meloni et al.

[11] Patent Number: 5,068,937

[45] Date of Patent: Dec. 3, 1991

[54] DEVICE FOR THE ACTIVATION OF PERBORATE IN WASHING MACHINES

[75] Inventors: Stefano Meloni; Carlo Rossi, both of Fabriano, Italy

[73] Assignee: Enea - Comitato Nazionale per la Ricerca e per lo Sviluppo Dell'Energia Nucleare e Delle Energie Alternative, Fabriano, Italy

[21] Appl. No.: 382,756

[22] Filed: Jul. 21, 1989

[30] Foreign Application Priority Data

Jul. 28, 1988 [IT] Italy ..... 48242 A/88

[51] Int. Cl.[5] ..... D06F 39/02

[52] U.S. Cl. ..... 8/158; 68/17 R; 68/207

[58] Field of Search ..... 18/17 R, 207, 18 R; 8/158

[56] References Cited

U.S. PATENT DOCUMENTS

| | | | |
|---|---|---|---|
| 3,095,463 | 6/1963 | Chang et al. | 68/207 X |
| 3,257,030 | 6/1966 | Vaughn et al. | 68/17 R |
| 3,804,297 | 4/1974 | Jurjans | 68/17 R X |
| 4,402,197 | 9/1983 | Groult et al. | 68/207 X |
| 4,434,629 | 3/1984 | Biancai et al. | 68/207 X |
| 4,463,582 | 8/1984 | Saalmann et al. | 68/18 R |
| 4,481,086 | 11/1984 | Bianchi et al. | 68/207 X |
| 4,489,574 | 12/1984 | Spendel | 68/207 |
| 4,858,449 | 8/1989 | Lehn | 68/17 R |

*Primary Examiner*—Frankie L. Stinson
*Attorney, Agent, or Firm*—Beveridge, DeGrandi & Weilacher

[57] ABSTRACT

This invention relates to a device for the activation of perborate in washing machines, said device comprising a cup (2, 8) for activating perborate which is fed by a perborate metering device (1) or may also lack such device, and is connected to the washing tub (6) through a conduit (7) and is supplied with water through the conduit (9) for the supply of water from the water main, or a conduit (18) arranged as a by-pass in said conduit that supplies water from the water main, or through a conduit (19) connected to the bottom of the washing tub (6); said device also comprising an electric resistance (3) for heating water contained in said cup (2, 8) or at a point upstream said cup, and means (4) that detect the temperature inside said cup (2, 8).

23 Claims, 7 Drawing Sheets

Fig. 2b
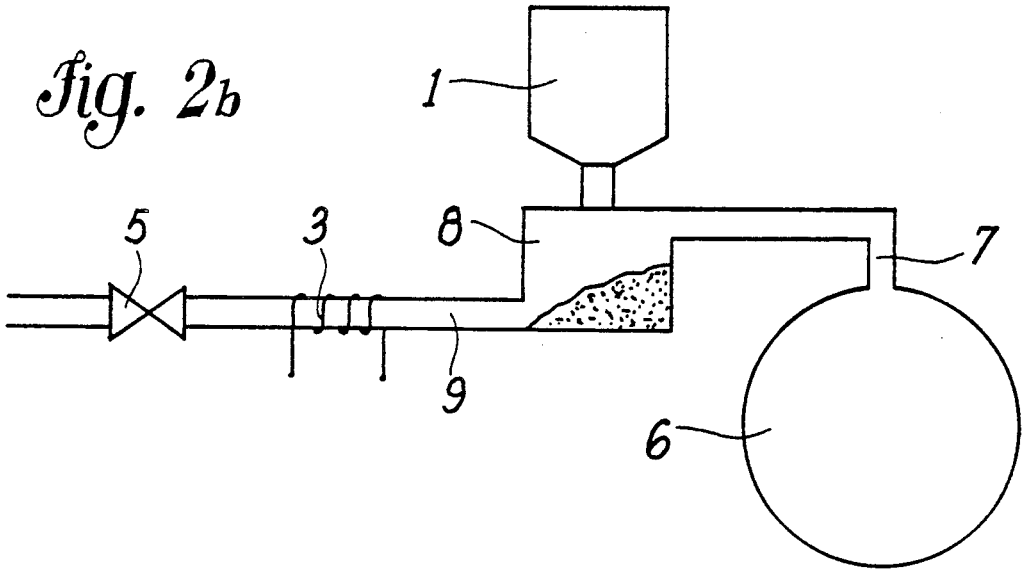
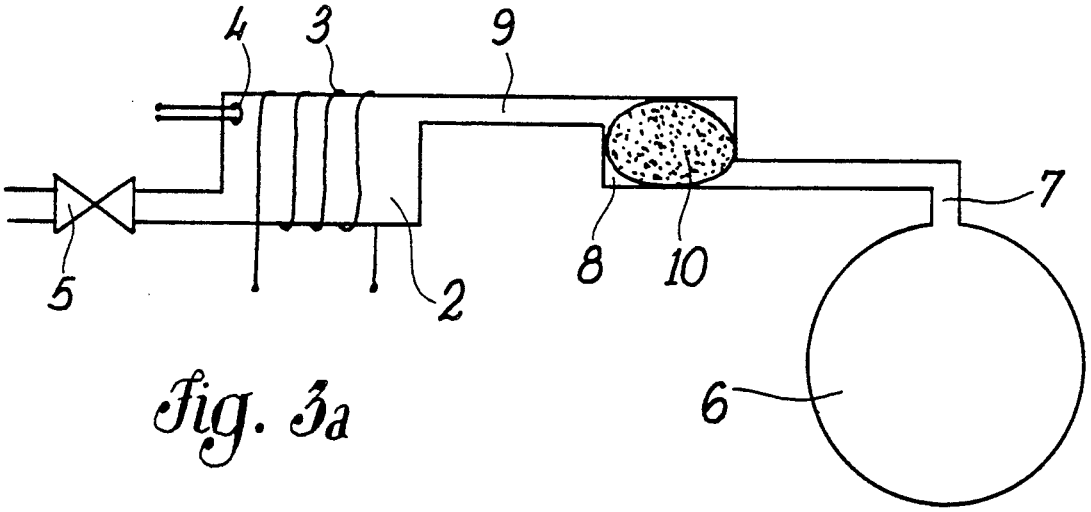
Fig. 3a
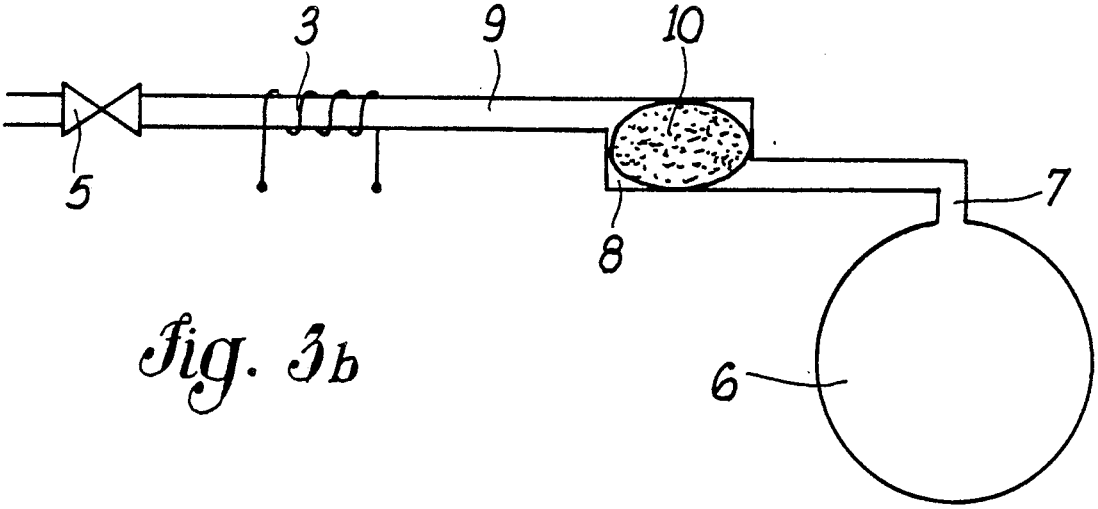
Fig. 3b

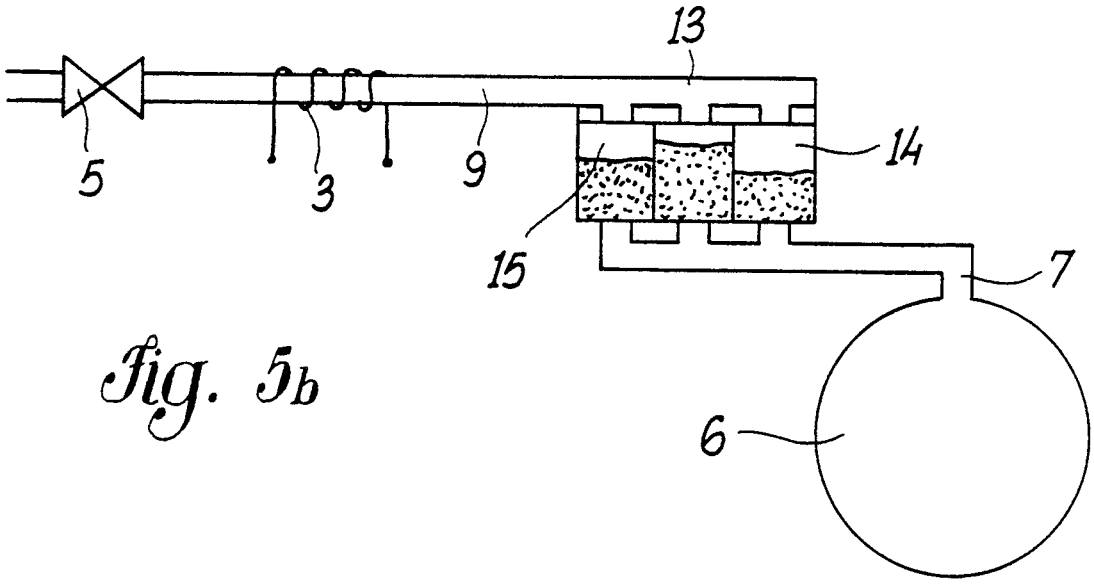
Fig. 5b
Fig. 6
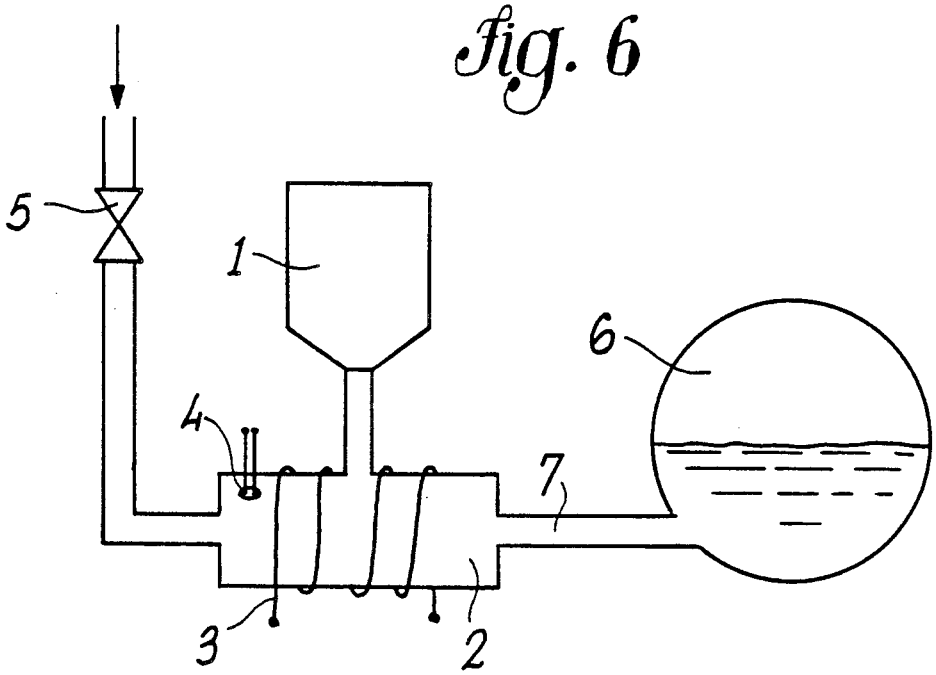

DEVICE FOR THE ACTIVATION OF PERBORATE IN WASHING MACHINES

This invention relates to a device for the activation of perborate in washing machines, and more particularly it relates to a device that allows perborate to be activated, and then the development of its bleaching action to occur, apart from the value of the washing water temperature.

The washing cycles designed in washing machines presently commercially available are carried out at different temperatures. The best effects as regards the cleaning action are obtained by means of washing operations performed at temperatures between 85° C. and 90° C.

Indeed, perborate contained in the detergent or introduced separately decomposes at those temperatures and gives rise to hydrogen peroxide that decomposes in turn into water and oxygen.

The oxidizing action of the latter on soil deposited on fibers supplies a strong bleaching effect.

To obtain such effect it is necessary to heat all washing water up to the temperature suitable to generate the same.

Accordingly, in addition to a remarkable waste of power, as quite a large amount of water is to be heated with respect to the amount of water that is actually required to cause perborate to decompose, a limitation also occurs in exploiting such effect because not all fabrics can undergo washing at such high temperatures.

Hence it is evident that there is the need for a device capable of activating perborate and free from the drawbacks mentioned above, that allows the perborate action to be exploited even when washing fabrics that cannot be contacted with water at too high a temperature.

The activation device according to the present invention additionally allows a remarkable amount of power to be saved, as it is necessary to heat just a small amount of water, i.e. just the amount required to activate perborate itself.

These and other results are obtained according to the present invention, through the realization of a device which provided with means for heating a water amount that is suitable to generate the activation of perborate, before water is introduced into the washing basket, and a perborate metering means, independently of the detergent employed or on the basis of that already provided in the detergent itself.

Accordingly, it is a specific object of the present invention a device for activating perborate in washing machines, such device comprising a cup inside which the perborate is introduced to cause it to dissolve in water, a conduit for supplying water being arranged upstream said cup and a conduit for connection to the washing tub being arranged downstream the same, said device also comprising means for heating water up to a temperature sufficient to cause the activation of perborate; and means that regulate the operation of said heating means up to the temperature that is required for activating perborate.

The heating means, which can be made up of a heating electrical resistance, heat water directly within said cup or within a second cup upstream the same or directly within the supply conduit. In case heating occurs inside the cup or inside the second cup, a thermostat is provided that disconnects the heating electrical resistance when the desired temperature is obtained.

Preferably, a metering device is associated to said cup, for metering the perborate into the cup itself.

Perborate can also be introduced directly into said cup, inside a container that is so constructed as not to allow perborate to leak out when it is in the form of a powder or of a tablet, a filter being provided in that case at the outlet of said cup, such preventing the tablet from going out.

Perborate can also be put into the cup of the usual detergent distributing device provided in washing machines.

Again according to the present invention, a two-way solenoid valve is arranged in the conduit that supplies water into the cup, such conduit being provided as a by-pass on the conduit for supplying water to the washing machines, said valve introducing water into the cup after activating perborate and introducing water containing activated perborate into the washing tub, or it is provided with a flowrate control device in case heating is performed directly inside the supply conduit.

The connection between the cup and the washing tub can be realized at the top of the tub itself or at a level lower than the level of the washing liquid.

In that second instance, the connection conduit between the cup and the washing tub is to be of length and diameter of suitable values to prevent washing water from becoming mixed with water heated inside the cup before said water is conveyed into the washing tub itself.

Otherwise, if the cup is provided at a position very close to the washing tub, a single-direction pressure valve can be arranged in the conduit connecting the cup to the washing tub.

Further according to the present invention, a three-way valve can be provided at the branch point of the conduit that supplies water to the cup in the conduit that loads water into the washing machine, said three-way valve supplying water in the water loading step to the detergent cup and, in the bleaching step, supplying water towards said cup for the activation of perborate.

Again according to the present invention the conduit for introducing water into the activation cup can be connected to the washing tub, the cup being fed by water present in the washing tub by means of a pump provided in said conduit that introduces water into the cup.

According to a further embodiment of the present invention, said conduit that introduces water into the activation cup is connected to the discharge conduit of the washing machine by means of a three-way solenoid valve that conveys water to the discharge point or to the cup according to the washing cycle; water circulation in both cases being obtained through the discharge pump of the washing machine.

In both cases it is possible to employ a single electrical resistance both for heating water and for activating perborate.

It is also to be considered as a specific object of the present invention a device of the type mentioned above, in which the perborate is transferred to the activation cup from the washing tub into which the perborate is introduced together with the detergent by means of a pump arranged in the connection conduit between the bottom of the washing tub and the cup, a further thermostat being provided in said washing tub, such thermostat interrupting the circulation of water inside the circuit consisting of washing tub-activation cup-washing tub, when water temperature inside the washing tub has reached the temperature of the cycle programmed for the washing machine, as an effect of heating water within the activation cup.

Preferably, the water circulation pump consists of the discharge pump of the washing machine, a three-way valve being provided downstream said discharge pump, said valve conveying water towards the activation cup or towards the discharge point.

This invention will be disclosed in the following according to some preferred embodiments of the same with particular reference to the figures of the enclosed drawings, wherein:

FIG. 1 shows a particular embodiment of the device according to the present invention;

FIG. 2*a* shows a particular embodiment of the device according to the present invention.

FIG. 2*b* shows a particular embodiment of the device according to the present invention;

FIG. 3*a* shows a particular embodiment of the device according to the present invention;

FIG. 3*b* shows a particular embodiment of the device according to the present invention;

FIG. 4*a* shows a particular embodiment of the device according to the present invention;

FIG. 4*b* shows a particular embodiment of the device according to the present invention;

FIG. 5*a* shows a particular embodiment of the device according to the present invention;

FIG. 5*b* shows a particular embodiment of the device according to the present invention;

FIG. 6 shows a particular embodiment of the device according to the present invention;

FIG. 7*a* shows a particular embodiment of the device according to the present invention;

FIG. 7*b* shows a particular embodiment of the device according to the present invention;

Figure 1:
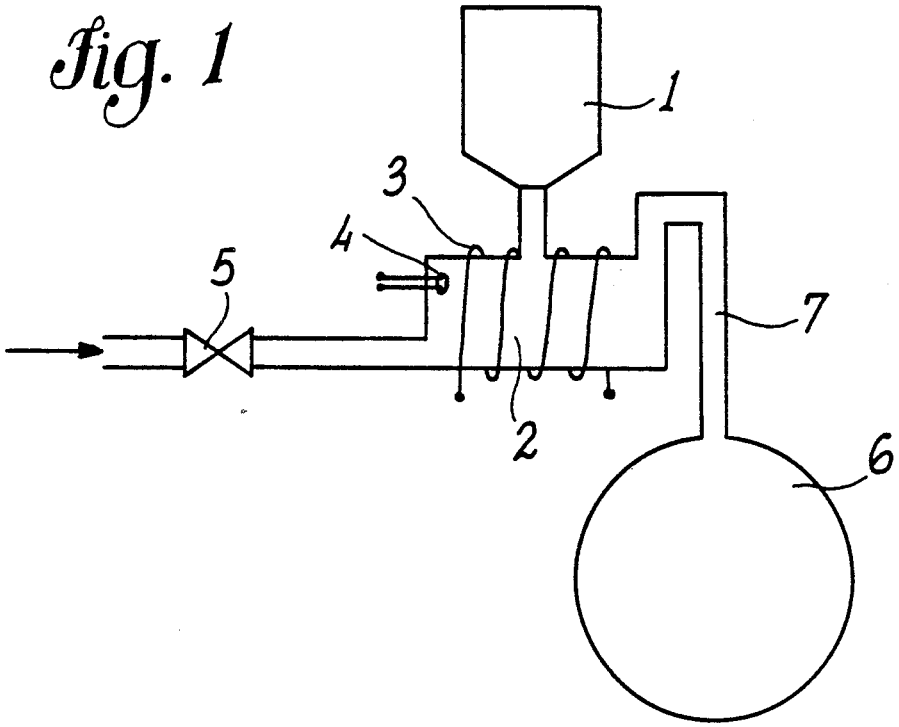

The device of FIG. 1 comprises a perborate metering device 1 of a type already commercially available, from which a predetermined amount of perborate is introduced during the bleaching step into the cup 2.

Water containing perborate dissolved is heated by means of an electric resistance 3 till the thermostat 4 points out that the desired temperature (about 85° C.) has been reached.

After disconnection of the electrical resistance 3, a solenoid valve 5 opens and causes water to flow from the water main, so conveying water containing perborate dissolved from the cup 2 to the washing tub 6 through the conduit 7.

The cup 2 is provided at a higher position with respect to the washing tub 6.

Figure 2A:
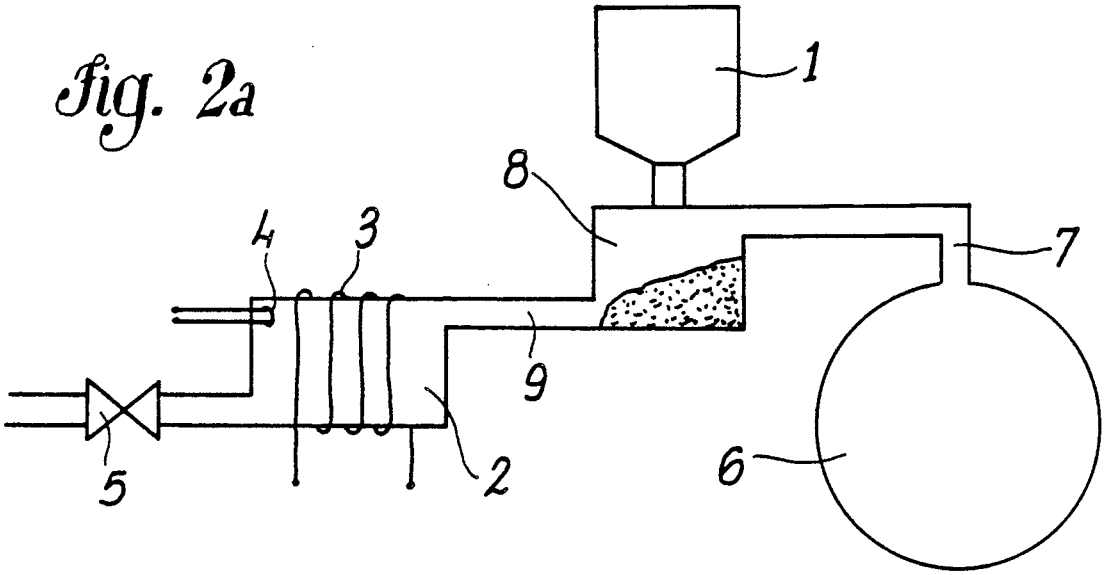

In the device of FIG. 2*a*, water is heated in the cup 2 before passing through the cup 8 in which the perborate correct amount is present.

The electrical resistance 3 heats water inside the cup 2 till the thermostat 4 points out that the desired temperature (about 85° C.) has been reached.

The action of opening the solenoid valve 5 causes hot water to be conveyed to the cup 8 in which the perborate becomes activated. Finally the activated perborate. reaches the tub 6 passing through the conduit 7.

The device according to FIG. 2*b* differs from that of FIG. 2*a* in that the electrical resistance 3 heats water upstream the cup 8, directly inside the conduit 9 that conveys water to the cup 2 from the solenoid valve 5.

The electrical resistance 3 is so designed as to supply water introduced from the solenoid valve 5 with a temperature increase higher than 75° C.

During the bleaching step, the correct metered amount of perborate is introduced into the cup 2. Then the electrical resistance 3 is connected and the solenoid valve 5 provided in that case with a flowrate control device opens.

Water inside the conduit 9 is heated up to a temperature higher than 85° C., so that perborate becomes activated.

The particular device embodiments shown in FIG. 3*a* and 3*b* correspond from the functional standpoint to those shown in FIGS. 2*a* and 2*b*, respectively, and they differ in that inside the cup 8 a perborate container 10 is provided instead of the perborate metering device 1, said container 10 being provided with a wall that allows water containing perborate dissolved to pass, whereas powder perborate is prevented from passing.

The operation is identical with that disclosed with respect to FIGS. 2*a* and 2*b*. Water is caused to flow in sufficient amounts to cause the metered amount of perborate to dissolve.

Figure 4A:
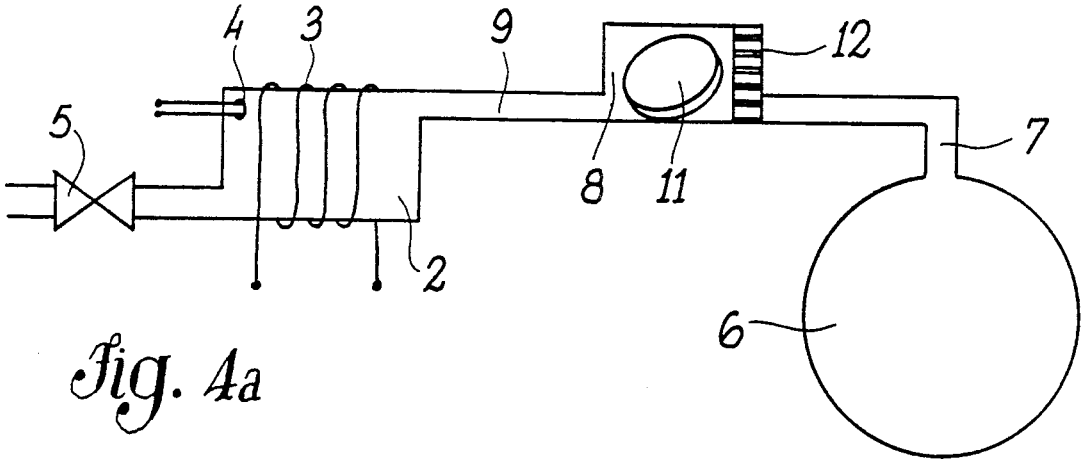
Figure 4B:
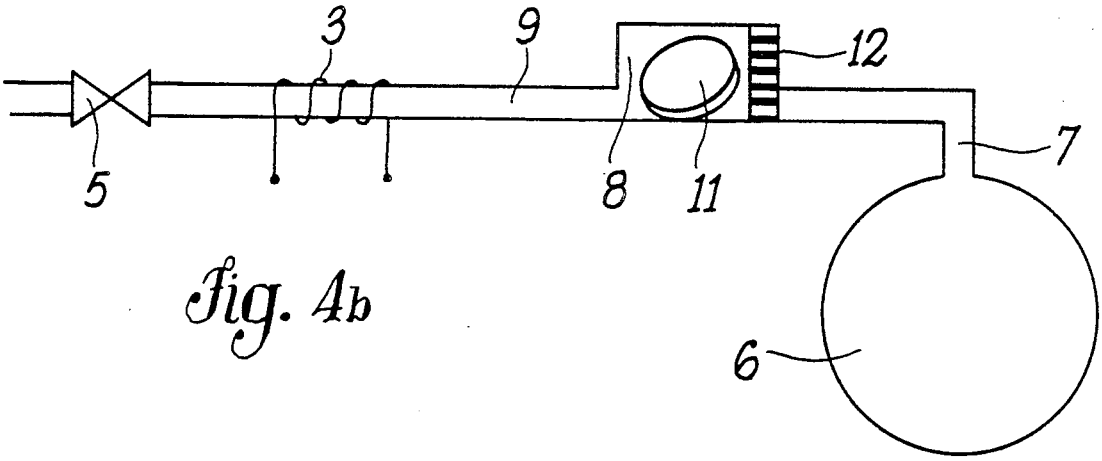

Devices shown in FIGS. 4*a* and 4*b* also correspond to those of FIGS. 2*a* and 2*b* respectively.

In that case, a perborate tablet 1 is supplied into the cup 2 instead of providing the perborate metering device 1. A filter device 12 is provided at the outlet of the cup 2, said filter preventing perborate from going out the cup during the outlet flow of water.

Figure 5A:
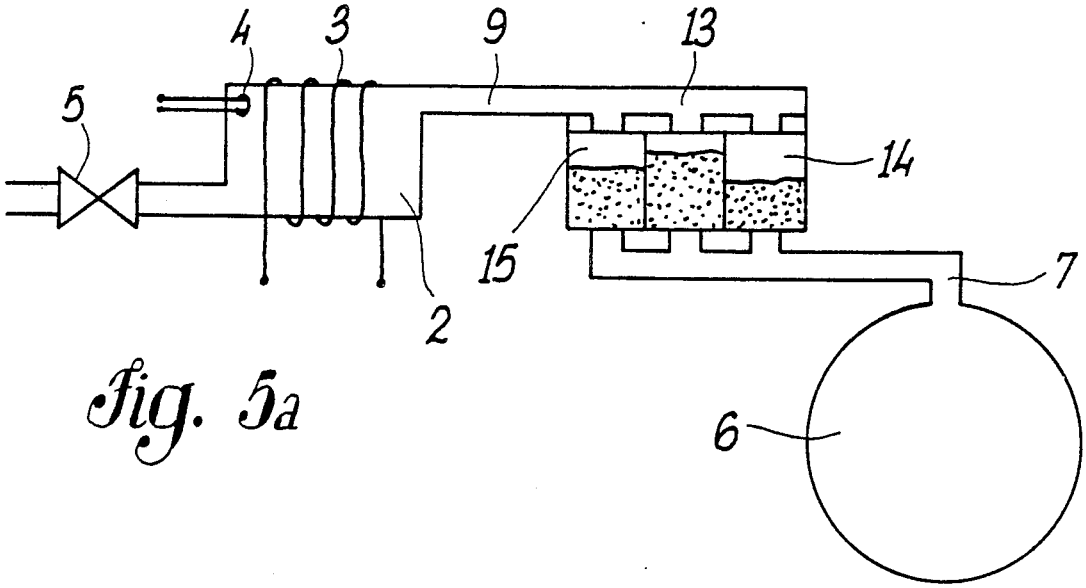

FIGS. 5*a* and 5*b* represent in turn two devices which substantially correspond to those shown in FIGS. 2*a* and 2*b*, respectively, in which water that has been heated is introduced directly through the conduit 9 by means of the distributing device 13 into the cup 14 for perborate already provided in the washing machine cup 15 for loading the detergent.

During the washing cycle, the electrical resistance 3 is not energized and water from the water main is conveyed through the washing machine timer-controlled distributor 13 into the cup 15 and then into the tub 6.

The next bleaching step operates as already disclosed above. In that case, water is conveyed from the distributing device 13 into the cup 14.

The device illustrated in FIG. 6 on the contrary introduces water containing activated perborate to a point at a level lower than the water level inside the tub 6 during the washing operation.

The conduit 7 is to be sufficiently long and of a reduced diameter so as to prevent water contained in the cup 2 and water contained in the tub 6 from becoming mixed.

Figure 7A:
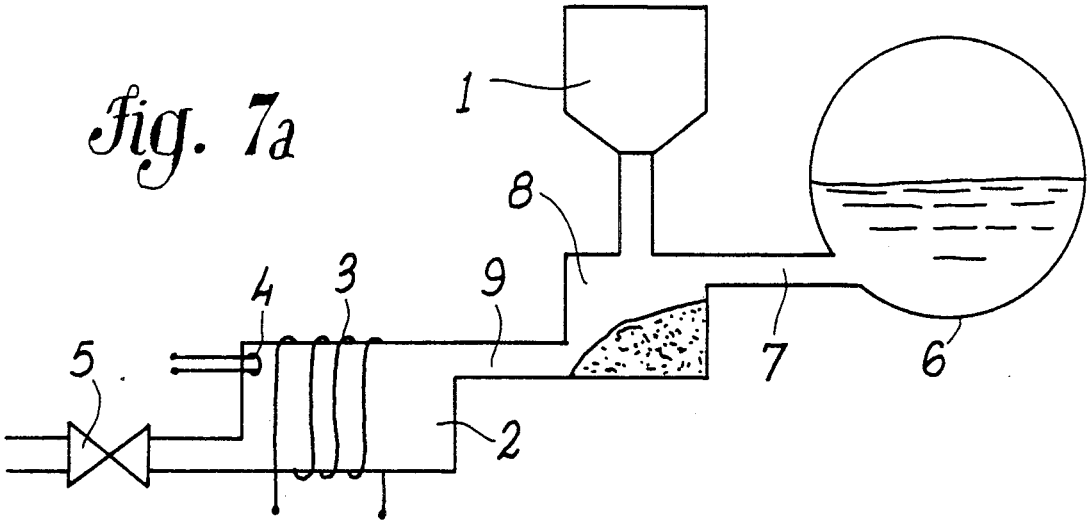
Figure 7B:
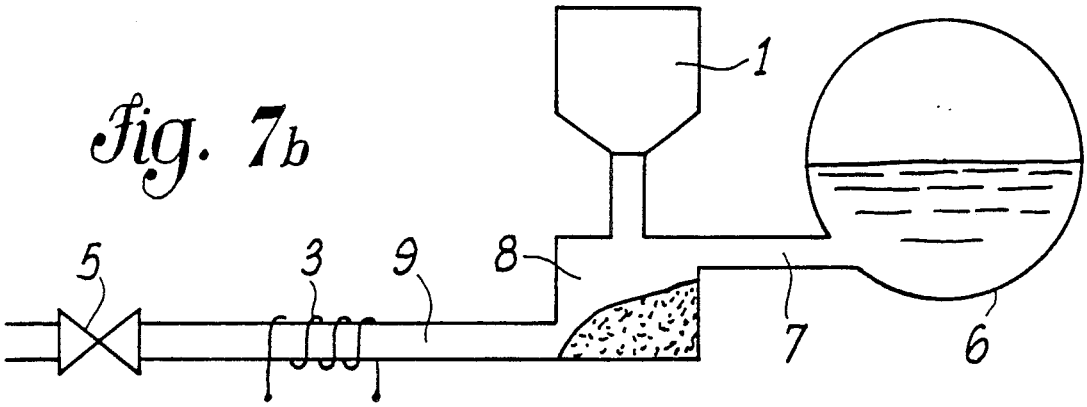

FIGS. 7*a* and 7*b* show two embodiments in which water heating occurs in the same way as that shown in FIGS. 2*a* and 2*b*, water being introduced into the tub 6 in the same way as that shown in the device of FIG. 6.

The same position for introducing water can also be adopted in the devices of FIGS. 3*a*, 3*b*, 4*a*, 4*b*, 5*a* and 5*b*. Such constructive solutions are not shown for the sake of simplicity.

Figure 8:
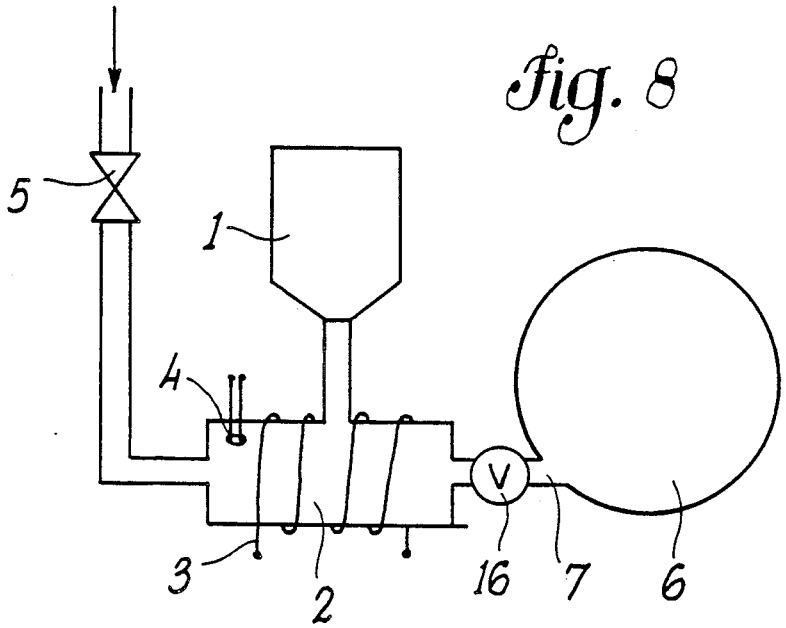
FIG. 8 shows a particular embodiment of the device according to the present invention.

If the conduit 7 is desired to be shorter in order to arrange the cup 2 very close to the tub 6, a pressure valve 16 can be inserted, as shown in FIG. 8. The valve 16 can also be adopted in the other cases in which the water introduction level is below the level of the tub 6.

The valve 16, which is normally in the closed position, is opened just at the moment when hot water is introduced into the tub 6 as an effect of the water main pressure.

As can be remarked, the embodiments shown in the preceding figures, apart from those of FIGS. 5*a* and 5*b*, provide the addition of a solenoid valve 5 besides that already provided in the washing machine itself.

Figure 9:
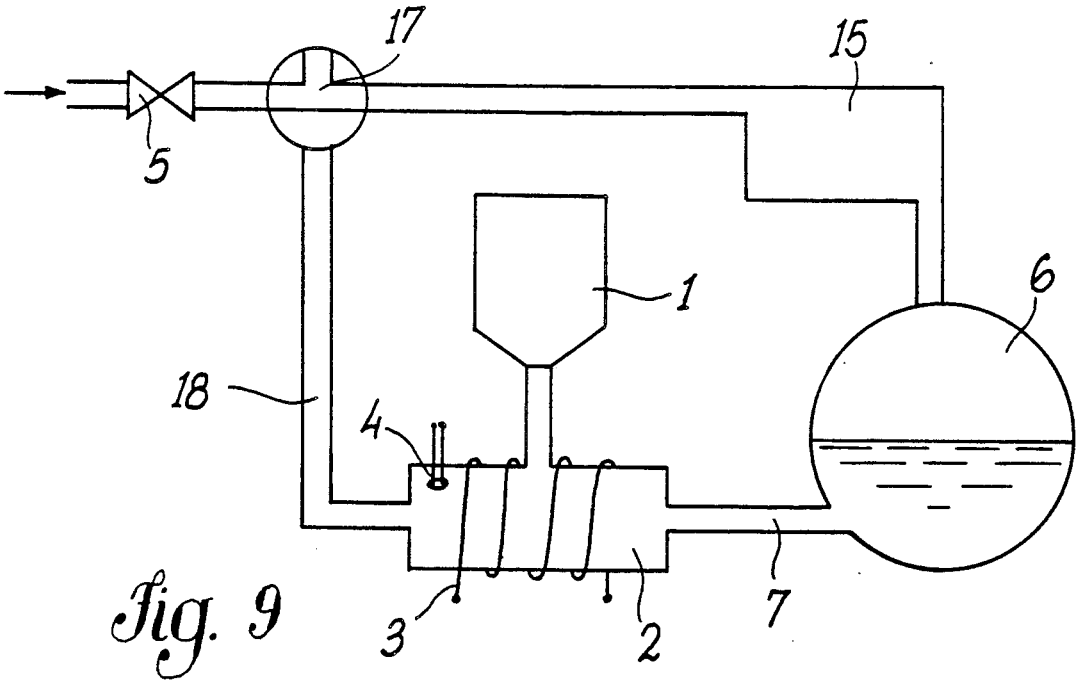
FIG. 9 shows a particular embodiment of the device according to the present invention.

The device of FIG. 9 provides on the contrary a three-way valve 17, which is controlled by a timer, said valve causing water to pass, during the loading step, through the detergent cup 15, whereas during the bleaching step, water flows through the conduit 18 towards the heating cup 2, from which cup it is transferred, after being heated and with the perborate dissolved in it, into the tub 6.

Such kind of circuit can also be realized according to the constructive solutions of the device according to the present invention which are shown in FIGS. 2*a*, 2*b*, 3*a*, 3*b*, 4*a* and 4*b*.

Figure 10:
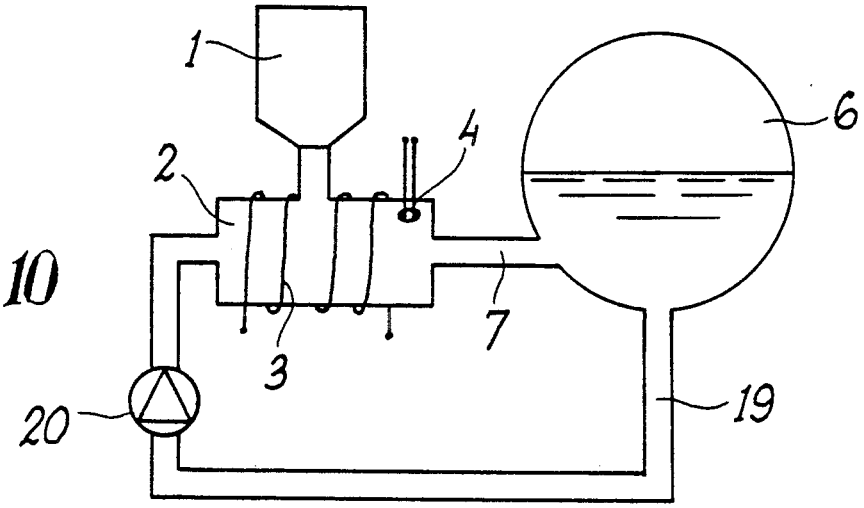
FIG. 10 shows a particular embodiment of the device according to the present invention.

The device of FIG. 10 draws the amount of water needed for dissolving perborate from the washing tub 6 through the conduit 19.

In order to perform the bleaching step, perborate is metered into the cup 2 and then heated by means of the electrical resistance 3.

The circulation pump 20 pushes activated water along the conduit 3 and into the tub 6, simultaneously recovering water from the tub 6 itself through the conduit 19.

As can be remarked, the embodiments illustrated in FIGS. 1–9 are provided with an additional heating electrical resistance with respect to that already present inside the washing tub.

On the contrary, the electrical resistance 3 can be employed as the only heating resistance in the device of FIG. 10.

While washing water is heated, the circulation pump 20 is kept in action till the thermostat arranged inside the washing tub 6 points out that the cycle programmed temperature has been reached. The next bleaching step is carried out according to ways already disclosed above.

Figure 11:
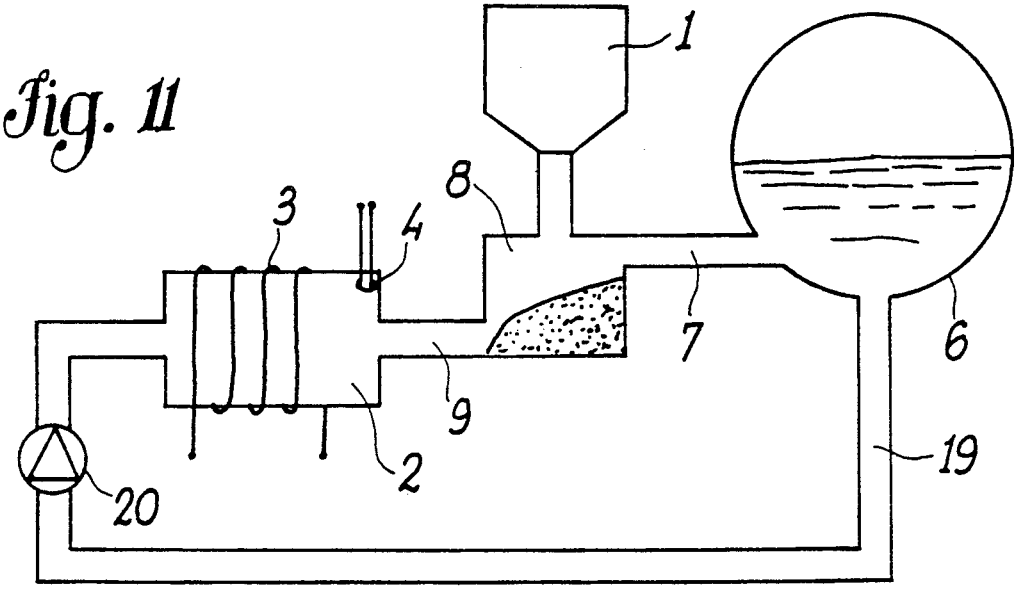
FIG. 11 shows a particular embodiment of the device according to the present invention.

In that case also it is possible to make arrangements for heating water inside a cup 2 assembled upstream the perborate cup 8, as shown in FIG. 11, with a constructive solution similar to those of FIGS. 2*b*–5*b*.

Figure 12:
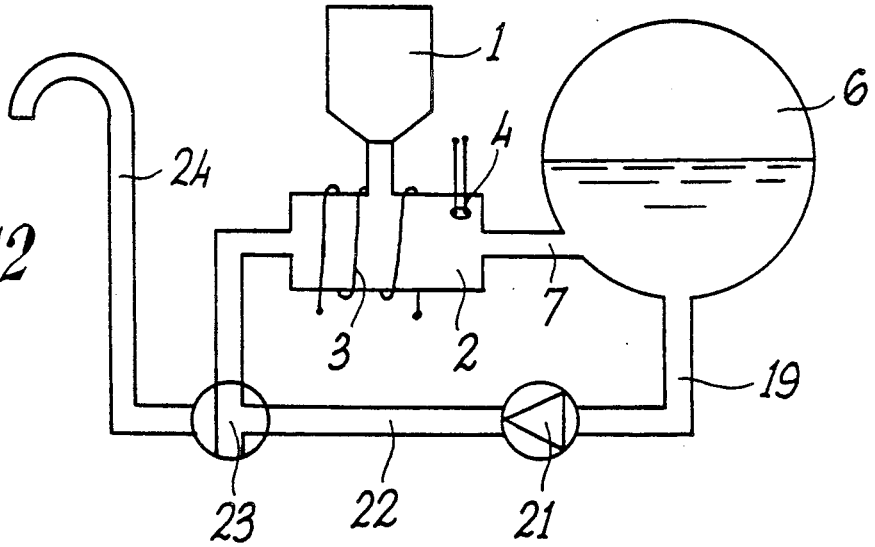
FIG. 12 shows a particular embodiment of the device according to the present invention.

Differently from the device of FIG. 10, in which it is necessary to supply an additional circulation pump 20 with respect to the pump already assembled in washing machines for the discharge operation, the device of FIG. 12 exploits for such operation said discharge pump 21 in order to cause water contained in the cup 2 to circulate.

A three-way valve 23 is inserted in the conduit 22 between the pump 21 and the cup 2, said valve making the pump 14 to communicate with the cup 2 during the bleaching step, while conveying water towards the discharge pipe 24 during the discharge step.

In such device also it is possible to employ the electrical resistance 3 as the only heating resistance.

The same solution can be adopted in the case of the circuit of FIGS. 2*a*, 2*b*, 3*a*, 3*b*, 4*a*, 4*b*, 5*a* and 5*b*.

Figure 13:
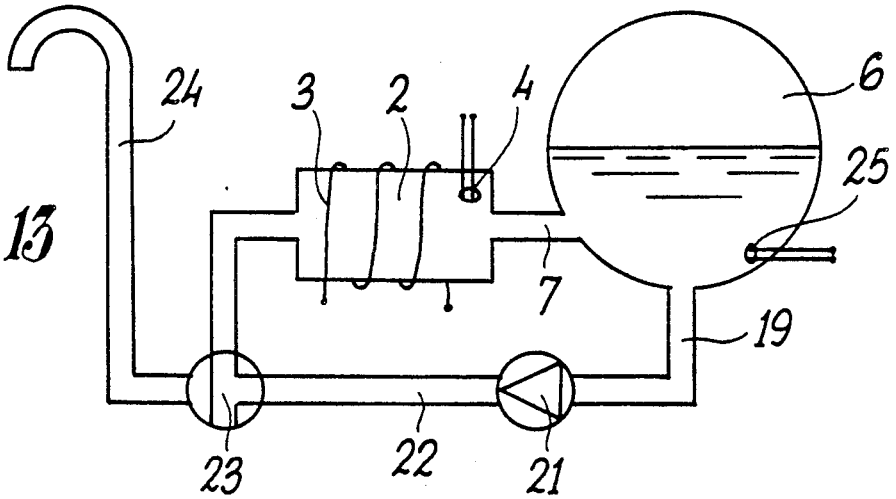
FIG. 13 shows a particular embodiment of the device according to the present invention.

If the employment of detergents already containing perborate is preferred, it can be sufficient to realize a device like that shown in FIG. 13, in which device the perborate metering means 1 is not provided, and other different means for the separate addition of perborate are not provided.

To obtain the desired effects, i.e. the bleaching step without heating the whole amount of water and hence even with fabrics that cannot undergo washing operations at too high temperatures, it is necessary to activate a significative fraction of the perborate contained in the detergent employed.

Washing water is caused to flow into the cup 2 at the temperature of the water main. The pump 21 will not be active continuously but just during pre-established periods, during the heating step by means of the electrical resistance 3.

A portion of water is thus caused to flow from the tub 6 into the cup 2 and heated up to the desired temperature that is pointed out the thermostat 4.

At that point, the pump 21 starts operating and draws more water from the tub 6, introducing simultaneously water containing activated perborate into the tub through the conduit 3.

The cycle is repeated till the thermostat 25 assembled inside the tub 6 signals the reaching of the cycle programmed temperature.

Through this last embodiment does not allow the obtainment of an optimal reduction in power consumption, it has the advantage of dispensing with the need for using the perborate metering device.

Moreover, it is to be remarked that perborate is present in notable amounts in detergents commercially available, so that by heating just a portion of washing water containing the detergent dissolved up to 85°, the same bleaching effect is obtained.

As an example, a washing cycle of a washing machine exploiting the device of the embodiment of FIG. 12 is disclosed herein below.

The cycle lasts 2 hours, the final step of washing and centrifuging being included. Such time is similar to that of the cycle at 90° C. performed according to the traditional ways in the test washing machine.

In the first washing step, the detergent (120 g of standardized IEC detergent) is loaded, then the washing water is heated up to 40° C. and the washing operation is carried on for a total time of 30 minutes from the beginning of the cycle.

Next the bleaching step is carried out.

40 g of perborate is metered into the cup 2, keeping the pump 14 inoperative.

Then the electrical resistance 3 is connected and water in the cup is heated up to the desired temperature of 90° C. The thermostat 4 controls the electrical resistance 3 so that the temperature of water inside the cup 2 is kept between 90° C. and 92° C.

This heating step is carried out for 15 minutes. Next the resistance 3 is disconnected, the pump 21 is started so as to cause water in the cup 2 to flow into the washing tub 6.

The cycle is then carried out for a total time of 2 hours.

To estimate the advantages so obtained, the IEC test has been adopted, with standard patches for determining the amount of soil removed (EMPA 105 patch).

The comparison performed by the same cycle without introducing perborate gives the following results:

as regards the soiling of white load, a change from a value of 2.5% without perborate to a value of −0.14% with perborate is observed, i.e., a percentage improvement of 2.64.

It is to be remarked that the value observed of 2.5% in the cycle without perborate points out that the white load becomes soiled during the washing operations, whereas the value of −0.14% points out an improvement on the whiteness degree;

as regards the percentage amount of soil removed, a change is observed from a value of 44.94% without perborate to a value of 57.9% with perborate, i.e., a percentage improvement of about 13.

The comparison has also been carried out by means of the same cycle as above, but introducing perborate at the beginning of the cycle together with the detergent.

In that case, the whiteness degree obtained is the same in both cycles, whereas as regards the percentage of soil removed, a change is observed from a value of 50.23% with the traditional cycle to a value of 57.9% with the modified cycle, i.e. an improvement of about 8%.

The present invention has been disclosed just for illustrative and not for limitative purposes, according to some preferred embodiments of the same, but it is to be understood that modifications and/or changes can be introduced by those who are skilled in the art without departing from the spirit and scope of the invention for which a priority right is claimed.

We claim;

1. A device for supplying perborate to washing machines and for activating the perborate to produce hydrogen peroxide which is effective to bleach fibers in washing machines, said device being characterized in that it comprises a cup into which the perborate is introduced, to cause the same to dissolve in water, a conduit for supplying water being arranged upstream of said cup, and a conduit connecting the cup to the washing tub of the washing machine being arranged downstream of said cup; said washing tub containing liquid at a temperature which is insufficient to activate perborate; said device also comprising means for heating water up to a temperature which is sufficient to cause perborate to become activated and is higher than the temperature of liquid in the washing tub; and means capable of controlling the operation of said heating means until the temperature required for activating perborate is obtained.

2. A device according to claim 1, characterized in that said heating means heat water directly inside said cup.

3. A device according to claim 2, characterized in that said means capable of controlling the operation of the heating means consist of a thermostat.

4. A device according to claim 1, characterized in that said heating means heat water contained in a second cup which is assembled upstream said cup in the conduit that supplies water.

5. A device according to claim 4, characterized in that the perborate is supplied directly into said cup inside a container which does not allow perborate to leak out when it is in the form of a powder.

6. A device according to claim 4, characterized in that the perborate is put into said cup in the form of a tablet, filtering means being provided at the outlet of the cup which prevent the tablet from going out when water flows out of the cup.

7. A device according to claim 4, characterized in that said cup is provided in the detergent distribution device of the washing machine.

8. A device according to claim 1, characterized in that said heating means are provided directly in the supply conduit upstream said cup.

9. A device according to claim 8, characterized in that a two-way solenoid valve including a flowrate control device is arranged in the conduit supplying water to said cup, said conduit being introduced as a by-pass in the conduit feeding water to the washing machine, said solenoid valve becoming activated simultaneously with said heating means.

10. A device according claim 1, characterized in that a perborate metering device is associated to said cup.

11. A device according to claim 1, characterized in that a two-way solenoid valve is arranged in the water supply conduit to said cup, which conduit is introduced as a by-pass in the conduit for feeding water to the washing machine, said solenoid valve conveying water into the cup through said conduit after activation of the perborate, so causing water containing activated perborate to be transferred into the washing tub.

12. An activation device according to claim 1, characterized in that the connection between said cup and said washing tub is realized at points corresponding to the upper portion of the washing tub.

13. An activation device according to claim 1, characterized in that the connection between said cup and said washing tub is realized at at a point at a lower level with respect to the level of the washing liquid inside the tub.

14. An activation device according to claim 13, characterized in that the connection conduit between the cup and the washing tub is of such length and diameter as to prevent washing water from becoming mixed with water heated inside said cup before said heated water is transferred into the washing tub.

15. An activation device according to claim 13, characterized in that said cup is arranged at a position close to the washing tub, a single-direction pressure valve being provided in the connection conduit between the cup and said washing tub.

16. An activation device according to claim 1, characterized in that a three-way valve is provided at the branch point in the water supply conduit to the washing machine for the conduit that introduces water into the cup, said three-way valve causing water to flow in the water loading step towards the detergent cup, and in the bleaching step towards said cup for activating perborate.

17. An activation device according to claim 1, characterized in that the conduit for introducing water into the activation cup is connected to the lower portion of the washing tub, the cup being fed with water contained in the washing tub by means of a pump provided in said conduit for introducing water into the cup.

18. An activation device according to claim 17, characterized in that a single electric resistance is employed both for heating washing water and for activating perborate.

19. An activation device according to claim 1, characterized in that said conduit for introducing water into the activation cup is connected to the discharge pipe of the washing machine by means of the three-way solenoid valve that conveys water to the discharge point or to the cup according to the washing cycle; the circulation of water being obtained through the discharge pump of the washing machine assembled between the outlet of the washing tub and said solenoid valve.

20. An activation device according to claim 19, characterized in that a single electrical resistance is employed both for heating washing water and for activating perborate.

21. An activation device according to claim 1, characterized in that the perborate is transferred to the activation cup of the washing tub, into which it is introduced together with the detergent, by means of a pump assembled in the connection conduit between the bottom of the washing tub and the cup; a further thermostat being provided inside said washing tub which interrupts the circulation of water through the circuit consisting of washing tub-activation cup-washing tub when water temperature inside the washing tub has reached the programmed cycle temperature of the washing machine, as an effect of heating water inside the activation cup.

22. An activation device according to claim 21, characterized in that said pump for circulation of water consists of the discharge pump of the washing machine, a three-way valve being provided downstream said discharge pump, said valve conveying water towards the activation cup or towards the discharge cup.

23. A method of supplying perborate to washing machines and for activating the perborate to produce hydrogen peroxide which is effective to bleach fibers in washing machines, said method including the following steps:

introducing perborate into a cup; supplying water to the cup via a conduit which is arranged upstream of said cup to cause the perborate to become dissolved in the water; providing a washing tub containing liquid at a temperature which is insufficient to activate perborate; heating the water up to a temperature which is sufficient to the cause perborate to become activated and is higher than the temperature of liquid in the washing tub; controlling said heating until the temperature required for activating perborate is obtained; and, connecting the cup to the washing tub of the washing machine via a conduit which is arranged downstream of said cup.

* * * * *